United States Patent [19]

Magid

[11] 4,291,487

[45] Sep. 29, 1981

[54] INFLATABLE ARTICLE WITH EXTERNAL MEANS TO CONTROL INTERNAL MOVEMENT

[76] Inventor: Sidney H. Magid, 4th Fl., No. 10, Alley 5, La. 12, Jen Ai Rd., Sec. 4, Taipei, Taiwan

[21] Appl. No.: 4,549

[22] Filed: Jan. 18, 1979

Related U.S. Application Data

[63] Continuation-in-part of Ser. No. 907,049, May 18, 1978, abandoned.

[51] Int. Cl.[3] ..... A63H 3/06

[52] U.S. Cl. ..... 46/88; 46/90; 273/58 E

[58] Field of Search ..... 46/87, 88, 89, 90; 273/58 B, 58 F, 58 H, 58 J, 58 K, DIG. 20

[56] References Cited

U.S. PATENT DOCUMENTS

| | | | |
|---|---|---|---|
| 257,458 | 9/1882 | Baldwin | 273/58 E |
| 2,996,834 | 8/1961 | Berlow | 46/88 |

FOREIGN PATENT DOCUMENTS

| | | | |
|---|---|---|---|
| 502307 | 6/1929 | Fed. Rep. of Germany | 273/58 |
| 914353 | 5/1954 | Fed. Rep. of Germany | 273/58 F |
| 18821 | of 1895 | United Kingdom | 273/58 E |
| 21299 | of 1895 | United Kingdom | 273/58 E |
| 18821 | of 1895 | United Kingdom | 273/58 E |

*Primary Examiner*—John F. Pitrelli
*Assistant Examiner*—G. Lee Skillington
*Attorney, Agent, or Firm*—McAulay, Fields, Fisher, Goldstein & Nissen

[57] ABSTRACT

An inflatable article having a thin outer wall formed from a flexible, gas impervious, resilient material forming a closed surface. At least one hollow protrusion provided with a sealed end and an open end is associated with the wall, and at least one movable internal object is contained within the closed surface. A non-elastic connection member is attached on one side to the sealed end of the hollow protrusion and attached on the other side to the internal movable object. The article further includes an external control member connected to the sealed end of the hollow protrusion for imparting and controlling movement to the internal object through the connection member and extending from the protrusion externally of the closed surface so that the movable internal object will be moved when the user pulls the external control with the article in a restrained condition.

14 Claims, 9 Drawing Figures

INFLATABLE ARTICLE WITH EXTERNAL MEANS TO CONTROL INTERNAL MOVEMENT

CROSS REFERENCE TO RELATED APPLICATIONS

This application is a continuation-in-part of applicant's co-pending application Ser. No. 907,049 filed May 18, 1978 and now abandoned.

BACKGROUND OF THE INVENTION

1. Field of the Invention

The present invention relates to inflatable articles and more particularly, to an inflatable article having one or more internal movable objects therein, and one or more resilient protrusions by which one can easily control the movement of the internal movable objects by external controlling means thereof.

2. Description of the Prior Art

Air inflatable toys provide a great deal of pleasure and entertainment for children, especially for little children, since an inflatable toy has relatively light weight, and can be made in many forms. Such inflatable toys are generally made of plastics such as PVC film, and are readily produced at low costs. However, none of the conventional inflatable toys is provided with internal objects which can be controlled to move in response to a simple external controlling means, since it is difficult to do this without permitting air to escape.

SUMMARY OF THE INVENTION

Accordingly, it is a main object of the present invention to provide an inflatable article having attached to it external controlling means to control the movement of various objects therein for enhancing the enjoyment of children while playing such articles.

A further object of the present invention is to provide an inflatable article in which the components are readily manufactured and assembled, so that the article can be economically manufactured and sold at a relatively low cost.

Consequently, according to the present invention, there is provided an inflatable article comprising an inflating means attached to at least one side of a wall thereof; one or more resilient hollow protrusions extending inwardly or outwardly from one or more sides of the walls thereof, each protrusion having a sealed end and an open end; means attached to said sealed end and extending into said article with the other end of said means attached to another part of said article and on said means there are attached or connected various movable objects. Attached to said sealed end and extending outwardly from said article is an external controlling means whereby when the article is inflated through the inflating means attached thereto, the internal movable objects within said article will move if the user pulls the external controlling means and the protrusion is thereby caused to move in the direction of the pull.

Since pulling the external controlling means would cause the inflatable article to move in the direction of the pulling force, it is necessary to provide some means to restrain the article. This restraint may be a hand, a suction cup, a weight etc., or even another external controlling means attached to the opposite wall of said article. Movement of the internal objects are initiated and controlled by the external controlling means when the inflatable article is held in a restrained condition.

The arrangement is such that each internal object is returned to its initial position after the external controlling force is released.

These and other objects, features and advantages of the present invention will be more fully appreciated by referring to the following detailed description of some embodiments of the present invention with reference to the accompanying drawings.

DETAILED DESCRIPTION OF THE PREFERRED EMBODIMENT

Figure 1:
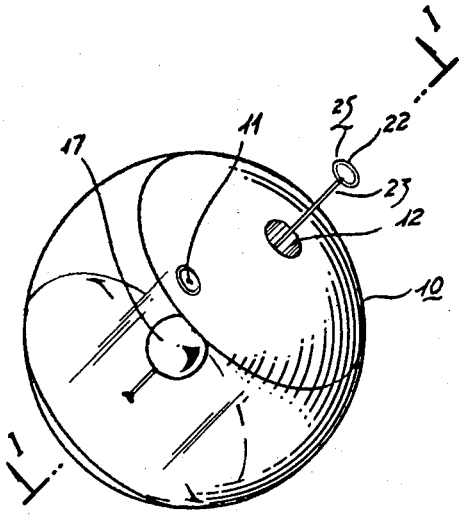
FIG. 1 is a perspective view of a ball-shaped inflatable article made in accordance with the teachings of the present invention.
Figure 2:
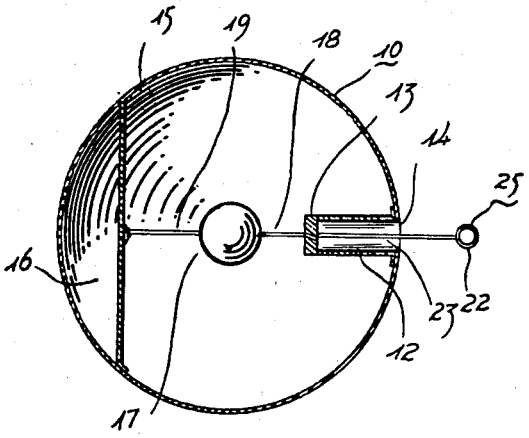
FIG. 2 is a transverse sectional view taken along line I—I of the embodiment shown in FIG. 1, and illustrating the interior construction of the embodiment.

Referring to FIGS. 1 and 2, there is a ball-shaped inflatable article 10 which is generally fabricated by a thin, gas impervious, flexible and resilient transparent sheet material such as PVC film which is suitable for fabrication into a closed surface by high frequency heat sealing or by adhesives in a manner conventionally well-known in the trade.

The inflatable article 10 is provided with an inwardly extending hollow protrusion 12 from one side of the wall thereof. An inflating means 11 such as a valve member for inflating the article is attached to the wall. The hollow protrusion 12 has a sealed inner end 13 and an open end 14, which is made of suitable resilient material such as PVC, plastics, or the like.

A member 15 such as a piece of flexible and resilient sheet is attached to an inner surface of the wall by any suitable means such as adhesives or heat sealing procedures.

Any rigid or elastic object or objects is provided in the inflatable article 10. As best shown in FIG. 2, a rigid object or article 17 is provided in a substantially central portion of said article 10. At one side of the rigid article 17 there is a non-elastic member 18 attached to the inner side of said sealed inner end 13 of said hollow protrusion 12, and at the opposite side of the rigid object 17 there is also a non-elastic member 19 attached to the central portion of the means 15 so as to suspend the object 17 in mid-air within the article 10. Of course, on the surface of the rigid object 17 one may make any funny picture for enhancing the interest of the child or there may be a bell in object 17.

An external controlling means 25 generally comprises a ring device 22 and a connecting cord member 23. The ring device 22 is connected with the outer side of said sealed inner end 13 of said hollow protrusion 12 by the connecting cord member 23, so that if the user pulls the ring devices 22, the hollow protrusion 12 will flex and be pulled back towards the wall to which it is attached, hence, the rigid object 17 will be moved from an initial position to a shaken position. However, since the hollow protrusion 12 and the flexible sheet 15 are made of resilient material, they will recover automatically after the external force on the external controlling means 25 is released thereby to permit the object 17 to return to its initial position.

Figure 4:
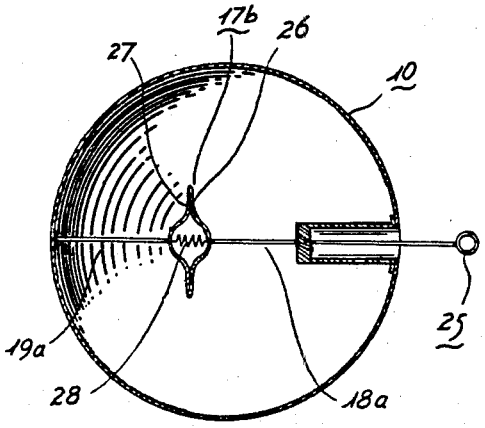
FIG. 4 is a sectional view of a third embodiment of the present invention.
Figure 5:
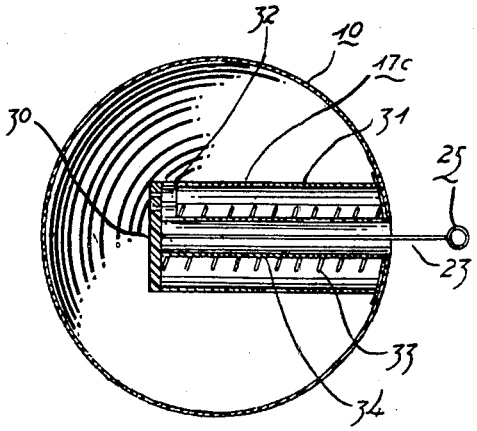
FIG. 5 is a sectional view of a further embodiment of the present invention.
Figure 3:
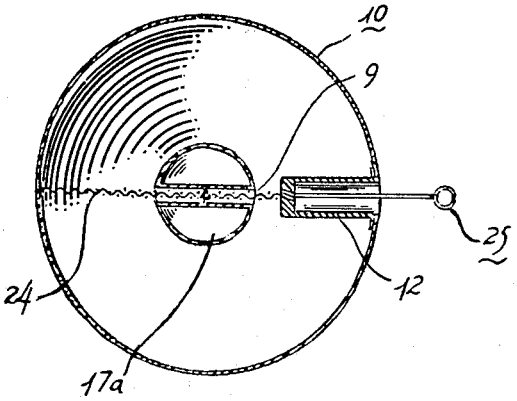
FIG. 3 is a sectional view of a second embodiment of the present invention.

Referring to FIGS. 3 to 5, there are three more embodiments of the present invention. All of the structural elements of the embodiments shown in FIGS. 3, 4 and 5 which are labelled with same numbers corresponding to the numbers in FIG. 2 are operated in exactly the same manner as those elements in FIG. 2. For the sake of brevity, only the differences are discussed in detail in this specification.

In FIG. 3, a ball-shaped inflatable article 10 has a hollow protrusion 12 extending inwardly from one side of the wall thereof and an external controlling means 25 as described previously.

An object 17*a* is provided with a sound-making device (not shown) such as a bell, a passage 9 therein, and an elastic member 24 extending through the passage 9. The ends of the elastic member 24 are attached to the inner side of said sealed inner end of said hollow protrusion 12 and the opposite inner wall of said inflatable article 10 respectively so as to suspend the object 17*a* in mid-air within said inflatable article 10. Therefore, sound will be made when the object 17*a* is caused to be shaken by said external controlling means 25 which is non-elastic.

In the embodiment of FIG. 4, a sound-making object 17*b* such as a set of cymbals is provided in the inflatable article 10; the object 17*b* includes two circular brass plates 26, 27 which are connected to each other by a member 28. One of the circular plates 26, 27 is attached to the inner side of said sealed inner end 13 of said hollow protrusion 12 by non-elastic member 18*a*, and the other one is attached to the opposing inner wall of said inflatable article 10 by non-elastic member 19*a* so as to suspend the object 17*b* in mid-air within the inflatable article 10. Therefore, said circular plates will bump each other to make a sound, like the sound of cymbals, when the user pulls and releases repeatedly said external controlling means.

Turning to FIG. 5, there is another embodiment of the present invention. Attached to one side of the inner wall of said inflatable article 10 is a partly flexible, resilient sound-making object 17*c* composed of a rigid end 30 attached with sound-making device 32 such as a voice, and two flexible walls 31 and 34. The cord member 23 of said external controlling means 25 is attached to the outer side of said rigid end 30, so that when the user pulls the external controlling means 25, the object 17*c* will expel air within it and then be returned by the spiral spring 33. The compression of said object 17*c*, due to air being expelled from within will cause the sound-making device 32 to make a sound.

Figure 6:
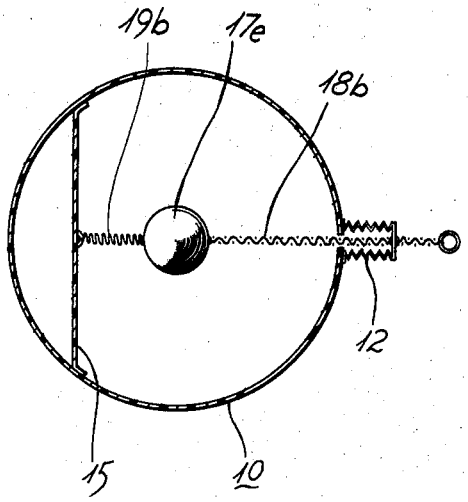
FIG. 6 is a sectional view of a still further embodiment of the present invention showing the protrusion on the outer surface of the inflatable article.

FIG. 6 shows a sectional view of a still further embodiment of the present invention. The inflatable article 10 is provided with a hollow protrusion 12 on the outside of the wall thereof. A member 15 as described hereinbefore which, for this embodiment is non-resilient is attached to another part of said article 10 by adhesives or heat sealing process. A movable object 17*e* is provided in the internal portion of said article 10. At one side of the object 17*e*, there is a non-elastic member 18*b* attached to the inner side of said sealed end of said protrusion 12, and at the opposite side of the object 17*e* there is also an elastic member 19*b* attached to the central portion of the member 15.

Figure 7:
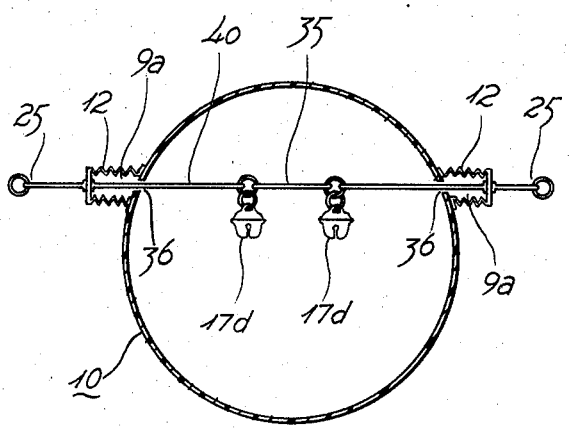
FIG. 7 is a perspective view of another embodiment of the present invention showing the protrusions collapsed in a normal condition.

Referring now to FIG. 7 which shows a sectional view of another embodiment of the present invention. A ball-shaped inflatable article 10 has two hollow protrusions 12 extending outwardly from two opposite sides of the wall thereof and two external controlling means 25 as described hereinbefore. Two objects 17*d* are provided with a sound-making device separately, a passage 9*a* therein, two non-elastic member 40 extending from the two objects 17*d* and through two holes 36 thereof, and a rubber band 35 between said two objects 17*d*. Ends of said two non-elastic member 40 are connected to the inner side of said sealed end of said hollow protrusions 12 separately. Whereby, sound will be made when the objects 17*d* are caused to be shaken by external controlling means.

Figure 8:
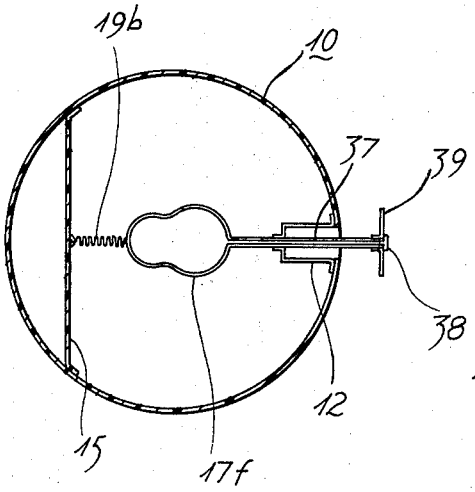
FIG. 8 is a sectional view of another embodiment showing a tube as the external controlling means and as the means connected to an internal movable object.

FIG. 8 shows a sectional view of another embodiment of the present invention. A ball-shaped inflatable article 10 has a hollow protrusion 12, and a non-resilient member 15 as described hereinbefore in connection with FIG. 6 is attached to another part of said article 10 by adhesive or heat sealing process. An inflatable movable object 17*f* is provided in the internal portion of said article 10. At one side of the object 17*f*, there is a hollow tube 37 attached thereto, and said hollow tube 37 is attached to the sealed end of said protrusion 12, and then continues through said hollow protrusion 12 to become an external controlling means. Said external controlling means has a closure 38 and a further component 39. This component 39 presents the external controlling means to be easily handled. At the opposite side of the object 17*f*, there is also an elastic member 19*b* attached to the central portion of the member 15.

Figure 9:
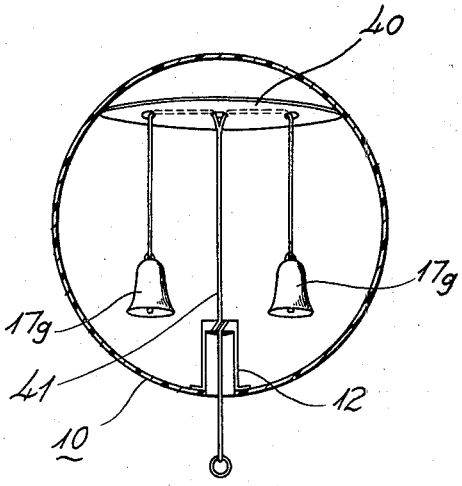
FIG. 9 is a perspective view of another embodiment with part of the surface of the inflatable article removed showing the use of the weight of the movable objects as the means to return the movable object to its initial position after an external controlling force is removed.

FIG. 9 shows a view of another embodiment of the invention. A ball-shaped article 10 has a hollow protrusion 12 and a supporting member 40 attached to the surface of said article 10 by adhesive or heat sealing process. A member 41 is connected to the sealed end of said hollow protrusion 12, and extends to said supporting member 40 and then to two movable objects 17*g* having sufficient weight to act as the means to restore the protrusion to its original position after the external force operating the external controlling means is removed.

While the invention has been described, disclosed, illustrated and shown in terms of embodiments or modifications which have assumed in practice, the scope of the invention should not be deemed to be limited by the precise embodiments or modifications herein described, disclosed, illustrated or shown; such other embodiments or modifications as may be suggested having the benefit of the teachings herein, being intended to be reserved especially as they fall within the scope and breadth of the claims appended herewith.

What is claimed is:

1. An inflatable article including a thin outer wall made of, at least in part, a flexible, gas impervious, resilient material forming a closed surface, said wall having a valve member attached thereto for inflating said closed surface;

at least one hollow protrusion attached to said wall and having a sealed end and an open end;

at least one movable internal object contained within said closed surface;

a non-elastic connection member attached on one side to the sealed end of said hollow protrusion and attached on the other side to said movable object;

connecting means within said closed surface for connecting said movable object to an inner surface of said wall, said non-elastic connection member and said connecting means serving to suspend said movable object within said closed surface; and external controlling means connected to the sealed end of said hollow protrusion for imparting and controlling movement to said internal object through said non-elastic connection member, said controlling means extending from said protrusion externally of said closed surface whereby said movable internal object will be moved when the user pulls the said external controlling means with said article in restrained condition.

2. An inflatable article according to claim 1, wherein said connecting means comprises a resilient member attached to said inner surface of said wall and a second non-elastic member connecting said resilient member to said movable object.

3. An inflatable article according to claim 1 wherein said at least one movable internal object is of such character that sound is made by them when they are caused to be moved by said external controlling means.

4. An inflatable article according to claim 1 wherein said hollow protrusion extends inwardly from the surface of the article.

5. An inflatable article according to claim 1 wherein said hollow protrusion extends outwardly from the surface of the article.

6. An inflatable article as claimed in claim 1, wherein said connecting means comprises an elastic member, said internal object being suspended to permit movement thereof related to said closed surface.

7. An inflatable article according to claim 6, wherein said external controlling means includes a hollow tube.

8. An inflatable article according to claim 7, wherein said movable object is an inflatable object and said hollow tube includes means connected to said inflatable movable object whereby said movable object can be inflated.

9. An inflatable article as claimed in claim 1, wherein said internal object includes a composite structure composed of two parts connected together by an elastic member, and said connecting means comprises a non-elastic member.

10. An inflatable article according to claim 1, wherein said connecting means comprises a non-resilient member attached to said inner surface of said wall and an elastic member connecting said non-resilient member to said movable object.

11. An inflatable article comprising:

a thin wall made of, at least part of it, a flexible, gas impervious, resilient material forming a closed surface;

a valve member attached to said wall for inflating said closed surface;

an inwardly extending hollow protrusion attached to said wall and having a closed inner end and an open outer end, said protrusion having flexible walls to permit movement thereof from an initial unflexed condition to a flexed condition;

an object or objects contained within said closed surface;

a non-elastic member attached on one side to the closed inner end of said protrusion and attached on the other side to said object or objects;

a spring member associated with said protrusion to return said protrusion to its initial unflexed condition; and, external controlling means connected to the closed inner end of said protrusion and extending through said protrusion outwardly past said wall to which said protrusion is attached whereby said object or objects will be moved when the user pulls the said external controlling means causing said protrusion to move to its flexed condition against the force of said spring member with said article in a restrained condition.

12. An inflatable article according to claim 11, wherein said object includes a sound-making device.

13. An inflatable article including a thin outer wall made of, at least in part, a flexible, gas impervious, resilient material forming a closed surface, said wall having a valve member attached to said wall thereof for inflating said closed surface;

one or more hollow protrusions attached to said wall, each having a sealed end and an open end;

at least one movable internal object contained within said closed surface, said object disposed for movement from an initial position to a shaken position;

a non-elastic member attached on one side thereof to the sealed end of said protrusion and on the other side thereof to said internal object; and external controlling means connected to the sealed end of each of said one or more protrusions and extending from said protrusion whereby said at least one movable internal object will be moved to its shaken position when the user pulls said external controlling means with said article in restrained condition, and will return to its initial position upon release of said external controlling means.

14. An inflatable article according to claim 13, wherein said internal object has sufficient weight to return to its initial position upon release of said external controlling means.

* * * * *